United States Patent [19]

Schurger

[11] 4,088,151

[45] May 9, 1978

[54] CYLINDER LOCKING APPARATUS

[75] Inventor: Joseph Anthony Schurger, Wooster, Ohio

[73] Assignee: Borg-Warner Corporation, Chicago, Ill.

[21] Appl. No.: 690,136

[22] Filed: May 26, 1976

[51] Int. Cl.[2] ..... F15B 11/08; F15B 13/042

[52] U.S. Cl. ..... 137/596.2; 91/445; 91/447

[58] Field of Search ..... 91/445, 447; 137/596.2

[56] References Cited

U.S. PATENT DOCUMENTS

| | | | |
|---|---|---|---|
| 3,030,929 | 4/1962 | Hipp | 91/447 |
| 3,049,101 | 8/1962 | Ruhl | 91/447 X |
| 3,068,596 | 12/1962 | Hein et al. | 91/445 X |
| 3,127,688 | 4/1964 | Hein et al. | 91/445 X |
| 3,906,840 | 9/1975 | Bianchetta et al. | 91/445 |
| 3,980,000 | 9/1976 | Iijima et al. | 91/445 X |

*Primary Examiner*—Irwin C. Cohen
*Attorney, Agent, or Firm*—Julian Schachner

[57] ABSTRACT

A cylinder locking apparatus primarily intended for use on counter-balanced lift trucks incorporating lift cylinders of the single-acting type, comprising a positive sealing poppet-type check valve which operates in the normal manner when the system is in the raise mode, but which in the lowering mode is operable by controlled pilot means triggered manually by the system's main control valve spool, thus permitting the load to be lowered by gravity.

3 Claims, 1 Drawing Figure

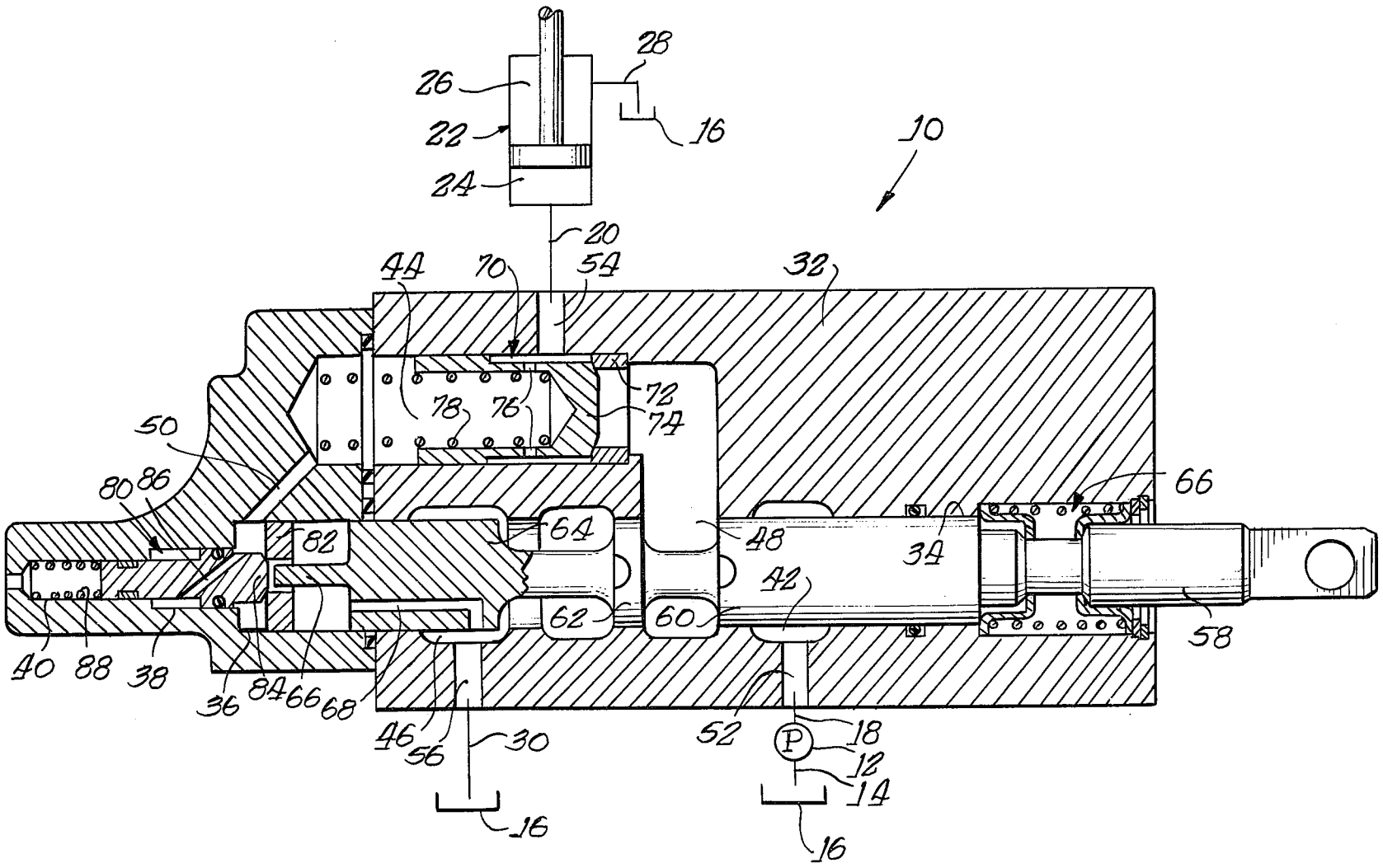
10
12
14
16
18
20
22
24
26
28
30
32
34
36
38
40
42
44
46
48
50
52
54
56
58
60
62
64
66
68
70
72
74
76
78
80
82
84
86
88

CYLINDER LOCKING APPARATUS

BACKGROUND OF THE INVENTION

This invention is directed generally to a fluid control system wherein a fluid motor is utilized for raising and lowering a load. In particular, it is directed to a fluid control system wherein a single-acting hydraulic cylinder is utilized for raising a load and the force of gravity is utilized for lowering the load.

Known systems of this type include a valve having a control valve spool slidable within a bore. Of necessity, a radial operating clearance must be provided to permit relatively free spool movement. Normally, movement of the valve spool to the raise position will direct hydraulic fluid to the lift cylinder so as to raise a load supported thereby. When the lift cylinder is supporting a load in an elevated position, the radial clearance between the valve spool and its associated bore provides a leakage path which may result in downward drift of the load.

One attempt to solve this leakage problem has been to provide a check valve between the lift cylinder and the control valve spool. When the load is to be lowered, it is necessary to cause the check valve to open so that fluid may be directed from the lift cylinder. In some instances, the check valve is vented across the control valve spool. This requires a complicated, precisely machined spool, and again could result in leakage which would cause downward drift of the load.

Often there has been provided some form of fluid pressure responsive pilot means for the check valve. This requires that a source of fluid under pressure be available at all times and, accordingly, leads to excessive energy utilization. Further, where a failure in the control system or a stalled engine, for example, is encountered, the available fluid pressure could be interrupted.

SUMMARY OF THE INVENTION

The cylinder locking device disclosed herein is primarily intended for use on a counter-balanced lift truck of the type which normally utilizes a lift cylinder of the single-acting type. A control valve directs hydraulic fluid to a cylinder in order to raise a load. Lowering is accomplished by venting the fluid from the cylinder, thereby allowing a gravity drop. The cylinder locking device prevents leakage across the control valve spool, which leakage could result in cylinder drift. Hydraulic fluid is held not by the spool-to-bore clearance, but rather by a positive sealing poppet-type check valve. In the raise mode, the check valve operates as a standard valve of this type. In the lowering mode, the check valve is operable by a pilot valve which in turn is triggered manually by movement of the control valve spool.

The pilot valve incorporates a differential area poppet, and is constructed such that the forces biasing the pilot poppet toward its seat are minimized. This is desirable since the pilot poppet is opened by manual effort when actuating the control valve spool.

BRIEF DESCRIPTION OF THE DRAWING

The objects and advantages of this invention will become apparent to those skilled in the art upon careful consideration of the specification herein, including the drawing, wherein there is illustrated a fluid control circuit incorporating a control valve for actuating a single-acting hydraulic cylinder. The circuit includes a cylinder locking device incorporating a check valve which normally prevents fluid flow from the lift cylinder. A pilot valve, manually triggered by movement of the control valve spool, actuates the check valve so as to allow fluid flow from the lift cylinder.

While this invention is susceptible of embodiment in many different forms, there is shown in the drawing and will be described in detail a preferred embodiment with the understanding that the present disclosure is to be considered as an exemplification of the principles of the invention and is not intended to limit the invention to this embodiment.

DESCRIPTION OF THE PREFERRED EMBODIMENT

Referring now to the drawing in more detail, there is illustrated a hydraulic system including a fluid control assembly 10. The system includes a pump 12 which draws hydraulic fluid through a line 14 from a reservoir 16, and which directs fluid under pressure through a line 18 to fluid control assembly 10. Assembly 10 is operable to control fluid flow through a line 20 to a single-acting lift cylinder 22 for raising a load. Lift cylinder 22 includes a head end 24 for receiving fluid under pressure from assembly 10 and a rod end 26 in fluid communication through a line 28 with reservoir 16. Assembly 10 also is operable to control fluid flow from the head end 24 of lift cylinder 22 through a line 30 to reservoir 16.

Assembly 10 includes a housing 32 which defines a bore 34 having stepped bore portions 36, 38 and 40. Housing 32 also defines an inlet core 42, an interior chamber 44 and a return core 46. An interior passage 48 communicates bore 34 with chamber 44. Another interior passage 50 communicates chamber 44 with bore portion 36 of bore 34.

An inlet passage 52 communicates inlet core 42 with the exterior of housing 32 to establish fluid communication with line 18. A work passage 54 communicates chamber 44 with the exterior of housing 32 to establish fluid communication with line 20. Similarly, a return passage 56 communicates return core 46 with the exterior of housing 32 to establish fluid communication with line 30.

A control valve spool 58 is slidably received in bore 34. Valve spool 58 defines lands 60, 62 and 64. Conventional spring means 66 biases valve spool 58 toward the central, neutral position shown in the drawing. In this position, land 60 blocks fluid communication from inlet core 42 to passage 48 and land 62 blocks fluid communication from passage 48 to return core 46.

Valve spool 58 also defines a projection 66 extending from land 64 and an interior fluid passage 68 within land 64 communicating bore 34 with return core 46.

A check valve 70 includes a valve seat 72 in chamber 44 adjacent passage 48. A check valve poppet 74 is slidably received within chamber 44 and defines a plurality of orifices 76 extending therethrough to communicate work passage 54 with the interior of chamber 44 behind poppet 74. A suitable spring 78 biases poppet 74 toward seat 72.

A pilot valve 80 includes a valve seat 82 in bore 34 adjacent bore portion 36. A pilot valve poppet 84 is slidable in bore portions 38 and 40, and defines a passage 86 therein communicating bore portion 36 with bore portion 38. Poppet 84 is of the differential area type such that fluid pressures in bore portions 36 and 38 develop a minimal force tending to bias poppet 84 toward seat 82. The force holding poppet 84 on seat 82 varies with the pressure created by lift cylinder 22. As the load pressure increases, the force acting on poppet 84 increases. The differential area may be designed, for example, such that with a 3,000 psi load pressure, only ten pounds would be required to unseat poppet 84 from seat 82. A spring 88 within bore portion 40 also biases poppet 84 toward seat 82. Spring 88 provides a relatively low biasing force, primarily to overcome drag forces acting on poppet 84. When poppet 84 is on seat 82, there is a slight clearance from projection 66 of valve spool 58, when valve spool 58 is in the neutral position.

In operation, assume that a load is supported by lift cylinder 22. Load pressure will be communicated to chamber 44 through passage 54 and orifices 76 of check valve 70. Thus, fluid pressure will hold poppet 74 against seat 72. Load pressure communicated through passage 50 will hold poppet 84 against seat 82. To raise the load, valve spool 58 is moved from the neutral position, shown in the drawing, to the right to its raise position. In the raise mode, land 60 establishes fluid communication from inlet core 42 to passage 48. Land 64 blocks fluid communication from passage 48 to return core 46.

Fluid is pressurized by pump 12 to a level slightly above the load pressure. Poppet 74 is moved off of seat 72, and fluid communication is established from passage 48 across check valve 70 and through passage 54 and line 20 to the head end 24 of lift cylinder 22. As a result, the load is raised.

Once the load has been raised, valve spool 58 is returned to its neutral position. Lift cylinder 22 exerts a load pressure on check valve 70 such that poppet 74 is held against seat 72. Pressure exerted on pilot valve 80 is such that poppet 84 is held against seat 82.

To lower the load, valve spool 58 is moved from the neutral position to the left to its lower position. In this mode, land 62 establishes fluid communication from passage 48 to return core 46. Land 60 blocks fluid communication from inlet core 42 to passage 48. Projection 66 physically unseats poppet 84 from seat 82. This creates a pilot flow path effectively dumping fluid from chamber 44 across pilot valve 80 and through passage 68 to return core 46 and reservoir 16. As a result, fluid flows from the head end 24 of lift cylinder 22 through orifices 76 of poppet 74. This develops a pressure drop across orifices 76 which is sufficient to change the force balance on poppet 74, causing it to move off of seat 72. When this takes place, a main flow path is established from the head end 24 of lift cylinder 22 across check valve 70 and land 62 of valve spool 58 to return core 46 and reservoir 16. The load supported by lift cylinder 22 is thus lowered by gravity.

The principal advantage of this device is its positive sealing characteristics wherein little or no leakage across valve spool 58 is permitted, resulting in minimal cylinder drift. A secondary advantage is that a load may be lowered without drawing power from the associated lift truck. This is particularly important where electrically operated trucks are encountered.

It should be understood that while a preferred embodiment of the invention has been shown and described, it should be considered as illustrative and may be modified by those skilled in the art without departing from the scope thereof, which is to be limited only by the claims herein.

I claim:

1. A flow control mechanism comprising a body defining a bore and an inlet, an outlet, and a first passage communicating with said bore, said body further defining a chamber communicating with said first passage, a second passage communicating said chamber with said bore, and a work port, said mechanism further comprising a spool slidable in said bore between a first position establishing fluid communication between said inlet and said first passage through said bore and a second position establishing fluid communication between said first passage and said outlet through said bore, said spool defining a third passage communicating said bore with said outlet, a check valve, said check valve having a check valve element movable between an open position establishing fluid communication between said first passage and said work port and a closed position blocking fluid communication therebetween, said check valve defining flow restricting means communicating said chamber with said work port, said check valve element being biased by fluid pressure in said chamber for movement toward its closed position, and a pilot valve, said pilot valve having a pilot valve seat in said bore, and a pilot valve element slidable in said bore between a seated position isolating said second passage from said third passage and an unseated position establishing fluid communication between said second passage and said outlet through said third passage, said pilot valve element being biased by fluid pressure in said second passage for movement toward its seated position, said pilot valve element being engageable and movable by said spool toward its unseated position upon movement of said spool toward its second position.

2. The invention of claim 1, said check and pilot valves having resilient means biasing said check and pilot valve elements toward their closed and seated positions respectively, said pilot valve being of the differential area type such that minimal bias is developed by fluid pressure in said second passage acting thereon.

3. The invention of claim 1, said body having first and second body portions, said first portion defining said inlet, said outlet, said first passage and said work port, said second portion defining said second passage, and said portions together defining said bore and said chamber.

* * * * *